US006135513A

United States Patent [19]

Hamada et al.

[11] Patent Number: 6,135,513

[45] Date of Patent: Oct. 24, 2000

[54] OPERATIONAL APPARATUS FOR VEHICLE SLIDE DOOR

[75] Inventors: Yoshikazu Hamada; Mitsuhiro Watanabe; Hirofumi Watanaba, all of Yamanashi-ken, Japan

[73] Assignee: Mitsui Kinzoku Kogyo Kabushiki Kaisha, Tokyo, Japan

[21] Appl. No.: 09/148,696

[22] Filed: Sep. 4, 1998

[30] Foreign Application Priority Data

Sep. 5, 1997 [JP] Japan ..... 9-257658
Sep. 5, 1997 [JP] Japan ..... 9-257659
Sep. 5, 1997 [JP] Japan ..... 9-257660

[51] Int. Cl.[7] ..... E05C 3/04

[52] U.S. Cl. ..... 292/201; 292/DIG. 46

[58] Field of Search ..... 292/216, 201, 292/DIG. 23, DIG. 46; 49/449

[56] References Cited

U.S. PATENT DOCUMENTS 4,502,246 3/1985 Minami .
4,968,074 11/1990 Yamagishi et al. ..... 292/201
4,986,579 1/1991 Ishikawa ..... 292/201
5,203,112 4/1993 Yamagishi et al. .
5,411,302 5/1995 Shimada ..... 292/201
5,520,425 5/1996 Dowling .
5,582,448 12/1996 Inoue ..... 292/336.3
5,605,363 2/1997 Kapes .
5,697,236 12/1997 Kleefeldt et al. ..... 292/201 X
5,718,465 2/1998 Dowling et al. .
5,737,876 4/1998 Dowling .
5,769,468 6/1998 Armbruster ..... 292/201
5,802,894 9/1998 Jahrsetz et al. ..... 292/201 X

*Primary Examiner*—B. Dayoan
*Assistant Examiner*—Gary Estremsky
*Attorney, Agent, or Firm*—Browdy and Neimark

[57] ABSTRACT

An operational apparatus for a vehicle slide door comprises an outer open lever connected to an outside handle of the door, an inside handle of the door rotatable in door-opening and door-closing directions, an inner open lever connected to the inside handle, a child-proof mechanism, a powered closing unit for closing the door from a half-latched position to the full-latched position, a fail-safe lever for interrupting an operation of the powered closing unit, a sub inner lever connected to the inside handle. The inner open lever transmits a door-closing rotation of the inside handle to the fail-safe lever without through the child-proof mechanism. The sub inner lever transmits a door-opening rotation of the inside handle to the fail-safe lever without through the child-proof mechanism. The fail-safe lever is moved in the same direction by either of the door-opening and the door-closing rotations of the inside handle.

9 Claims, 9 Drawing Sheets

OPERATIONAL APPARATUS FOR VEHICLE SLIDE DOOR

BACKGROUND OF THE INVENTION

1. Field of the Invention

The present invention relates to an operational apparatus for a vehicle slide door.

2. Description of the Related Art

As described in U.S. Pat. Nos. 5,203,112; 4,502,246; 5,605,363; 5,718,465 and the like, various operational apparatus for a vehicle slide door have been well known.

A first problem of the conventional operational apparatus of a vehicle slide door is in that a fail-safe mechanism which interrupts a closing operation of a powered closing unit for moving a slide door from a half-latched position to a full-latched position, is insufficient. The conventional fail-safe mechanism is arranged to be operated by an emergency operation of an outside operating handle which is provided on an outer surface of the slide door or by the emergency operation of an inside operating handle which is provided on an inner surface of the slide door. However, if a child-proof mechanism which may be installed in the operational apparatus is in a child-proof state, the emergency operation of the inside operating handle is not transmitted to the fail-safe-mechanism, therefore the fail-safe mechanism does not work.

A second problem is in that the inside operating handle can be turned only in one direction. A typical inside operating handle is turned by an operating force only in a backward direction of the vehicle body. Therefore, when moving the door backward to open it, the operating force is smoothly and effectively transmitted to the slide door. However, it is difficult to smoothly and effectively transmit, to the slide door, the operating force in the forward direction of the vehicle body which is necessary for closing the slide door. Further, in a case where the vehicle is provided with a latch type full-open holder such as a device described in U.S. Pat. No. 4,502,246 which holds the slide door in a full-open position, in order to close the door the inside operating handle should be pressed forward after the holder has been released by pulling the inside operating handle backward. Therefore, it is very difficult to smoothly close the slide door.

SUMMARY OF THE INVENTION

Accordingly, an object of the present invention is to provide an operational apparatus for a vehicle slide door, in which a fail-safe mechanism for interrupting a closing operation of a powered closing unit can be operated by the inside operating handle, even if a child-proof mechanism is in a child-proof state.

Another object of the present invention is to provide an operational apparatus for a vehicle slide door, in which the slide door can smoothly be opened and closed by making an inside operating handle capable of turning both in a backward direction equivalent to a door-opening direction and in a forward direction equivalent to a door-closing direction.

Additional aspects, objects, advantages, and features of the present invention will become apparent from the following description and appended claims, taken in conjunction with the accompanying drawings.

DESCRIPTION OF THE PREFERRED EMBODIMENT

Figure 1:
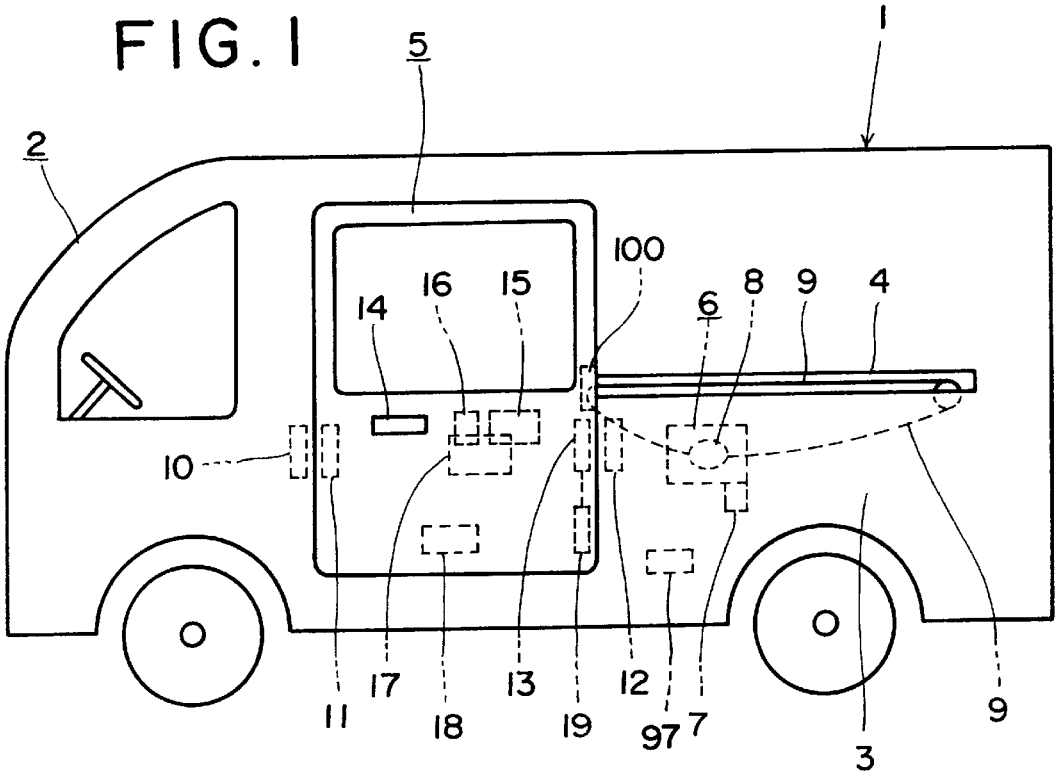
FIG. 1 is a side view of a vehicle having an operational apparatus for a vehicle slide door according to the present invention.

As shown in FIG. 1, a vehicle 1 comprises a vehicle body 2 and a slide door 5 which is slidably attached to a guide rail 4 fixed to a rear outer side panel 3 of the body 2. Inside the side panel 3, a powered sliding unit 6 for sliding the slide door 5 is provided. The sliding unit 6 has a reversible motor 7, a wire drum 8 rotated by the motor 7, and a wire cable 9 provided between the wire drum 8 and the door 5. When the wire drum 8 is rotated by the power of the motor 7, the wire cable 9 is pulled so as to slide the slide door 5 in a door-opening direction equivalent to a backward direction of the vehicle body 2 or in a door-closing direction equivalent to a forward direction of the vehicle body 2. A device which can be used as one example of the powered sliding unit 6 is described and illustrated in detail in U.S. Pat. No. 5,737,876.

The slide door 5 comprises a front latch unit 11 which is engageable with a front striker 10 fixed to the vehicle body 2, and a rear latch unit 13 which is engageable with a rear striker 12 fixed to the body 2. The latchunits 11, 13 hold the slide door 5 in a full-closed position (full-latched position) by being engaged with the strikers 10, 12. The front latch unit 11 and the front striker 10 may be often omitted.

Figure 2:
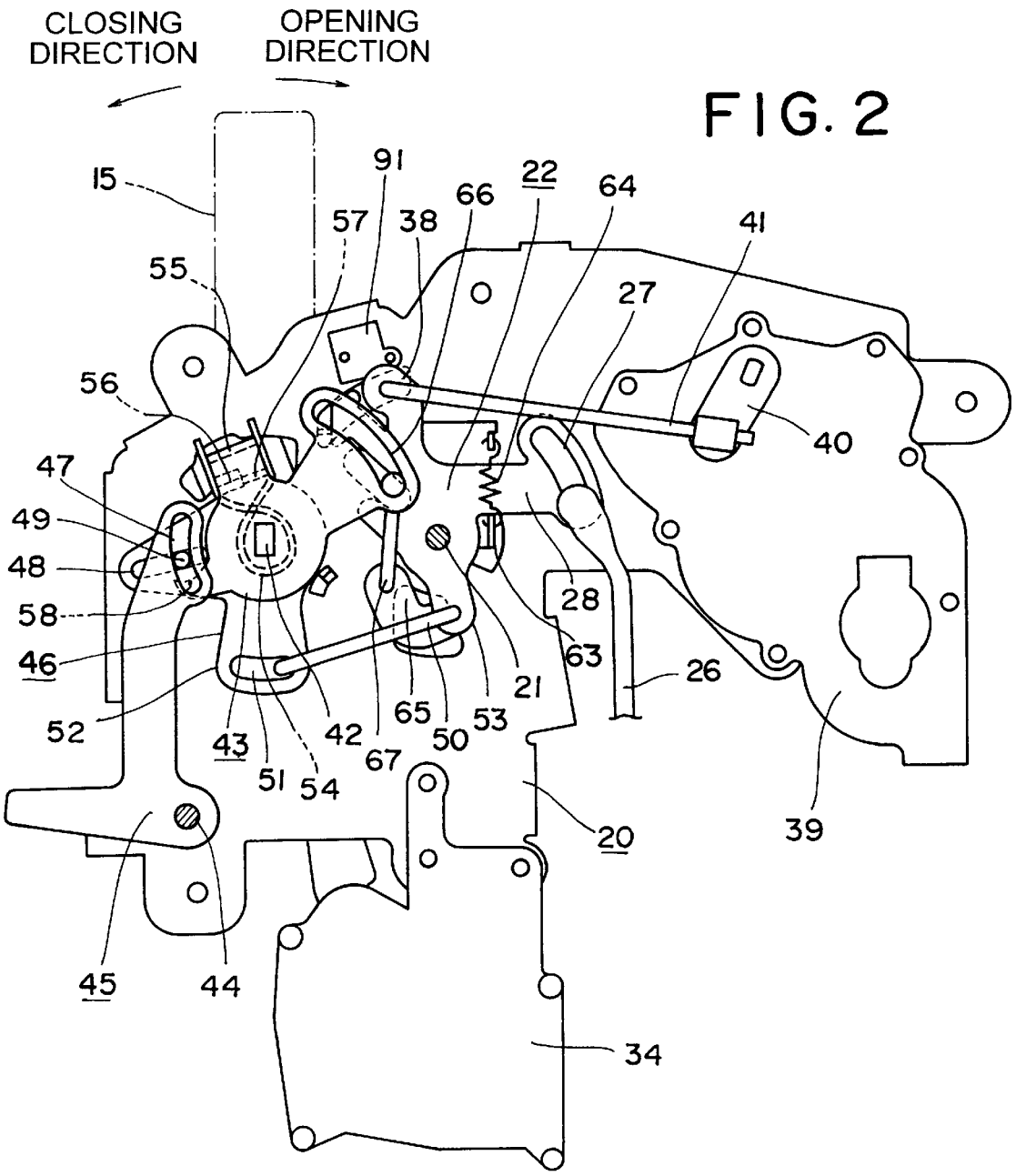
FIG. 2 is a front view of a relay assembly of the operational apparatus.
Figure 16:
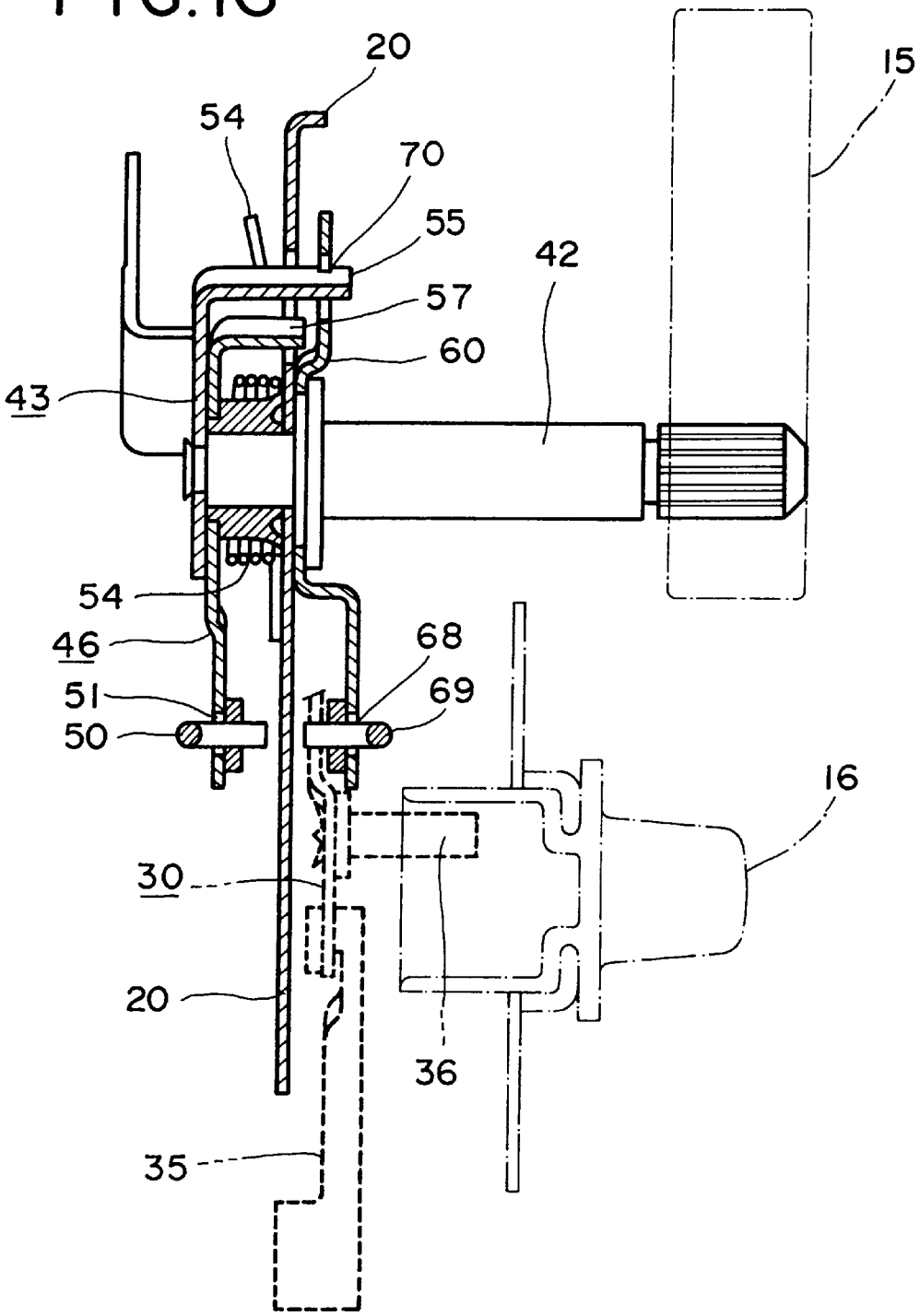
FIG. 16 is a vertical cross sectional view of the relay assembly showing an inside operating handle and an inside lock button.

The slide door 5 further comprises an outside operating handle 14 provided on an outer surface of the door 5, an inside operating handle 15 provided on an inner surface of the door 5, an inside lock button 16 provided on the inner surface of the door 5, a relay assembly 17 provided in the door 5, a wireless transmitter 18, and a powered closing unit 19 connected to the rear latch unit 13. The powered closing unit 19 transmits, to the rear latch unit 13, the power for moving the slide door 5 from a half-latched position to the full-latched position, when the door 5 is slid from the open position to the half-latched position by the power of the powered sliding unit 6 or by hand. The arrangements of the powered closing unit 19 and the rear latch unit 13 are briefly shown in FIG. 18 to be described later, but these arrangements are described and illustrated in detail in U.S. Pat. No. 5,520,425. As shown in FIGS. 2 and 16, a stick-shaped grip is used as the inside operating handle 15. The grip can be turned both in a backward direction of the vehicle body 2 equivalent to the door-opening direction of the door 5 and in a forward direction of the vehicle body 2 equivalent to the door-closing direction of the door 5. The inside handle 15 is held in a neutral position by a resilient force of a spring 54 (FIG. 2) as described later.

The vehicle 1 is provided with a full-open holder 100 for holding the slide door 5 in the full-open position. Various types of the full-open holder are well known, and in the present invention, a latch type one shown in U.S. Pat. No. 4,502,246 is used. However, a leaf spring can also be used instead of the expensive latch type holder. The spring type holder holds the slide door in the full-open position by an elasticity of the spring, therefore, no means for releasing the holder is necessary.

The relay assembly 17 comprises a door opening mechanism, a locking mechanism and a child-proof mechanism which will be described later in detail. The relay assembly 17 transmits operating forces of the operating handles 14, 15 through the door opening mechanism to the latch units 11, 13 and the full-open holder 100.

Figure 4:
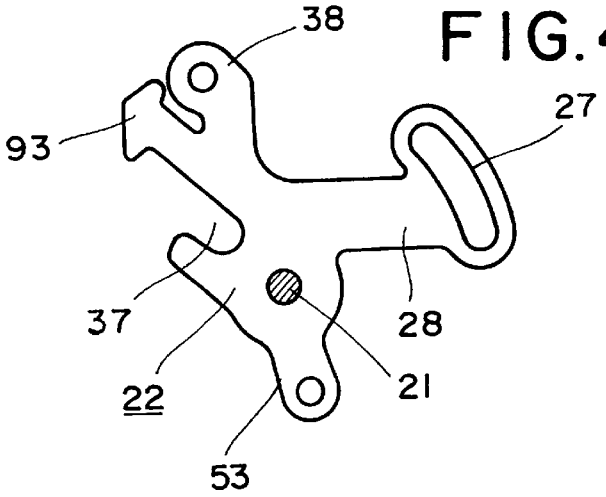
FIG. 4 is a front view of an outer open lever of the relay assembly.
Figure 6:
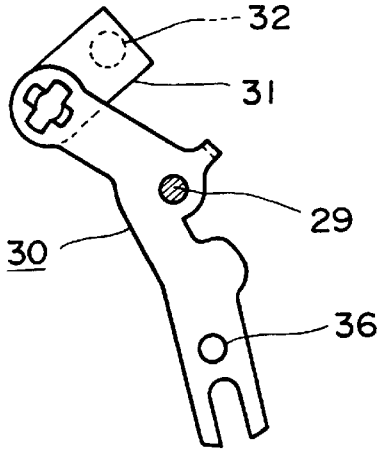
FIG. 6 is a front view of a lock lever and a lock link of the relay assembly.
Figure 5:
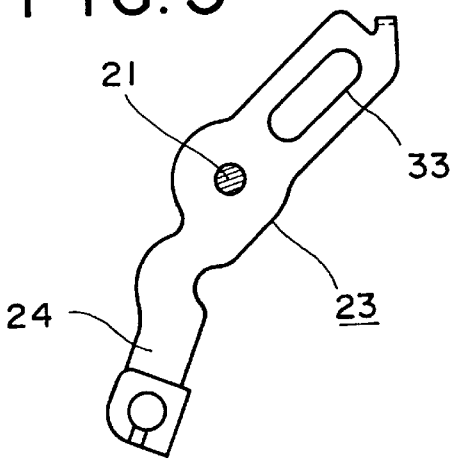
FIG. 5 is a back view of a latch-unit lever of the relay assembly.

The relay assembly 17 is shown in detail in FIGS. 2 to 16 and has a metal base plate 20 fixed to the slide door 5. The door opening mechanism of the relay assembly 17 has an outer open lever 22 (FIGS. 2 and 4) which is rotatably attached to a front side of the base plate 20 by a shaft 21, and a latch-unit lever 23 (FIGS. 3 and 5) which is rotatably attached to a rear side of the base plate 20 by the shaft 21 (not appeared in FIG. 3). A lower arm 24 of the latch-unit lever 23 is connected to the latch units 11, 13 through a rod or wire 25. When the latch-unit lever 23 turns counterclockwise in FIG. 3, the latch units 11, 13 release the strikers 10, 12, thereby the slide door 5 is opened.

The outer open lever 22 includes a right arm 28 having an elongated arc slot 27 to which one end of a rod 26 is connected with a lost-motion, and the other end of the rod 26 is connected to the outside operating handle 14. The outer open lever 22 and the latch-unit lever 23 are relevantly connected with each other through the locking mechanism.

The locking mechanism has a lock lever 30 (FIGS. 3 and 6) which is rotatably attached to the rearside of the base plate 20 by a shaft 29, a lock link 31 which is rotatably pivoted to an upper end of the lock lever 30, and a lock pin 32 which is formed at the lock link 31. The lock pin 32 penetrates a slot 33 formed in the latch-unit lever 23 and projects to the front side of the base plate 20. The lower end of the lock lever 30 is connected to an output lever 35 of a motorized actuator 34. The inside lock button 16 is relevantly connected to a projection 36 of the lock lever 30, as shown in FIG. 16.

Figure 3:
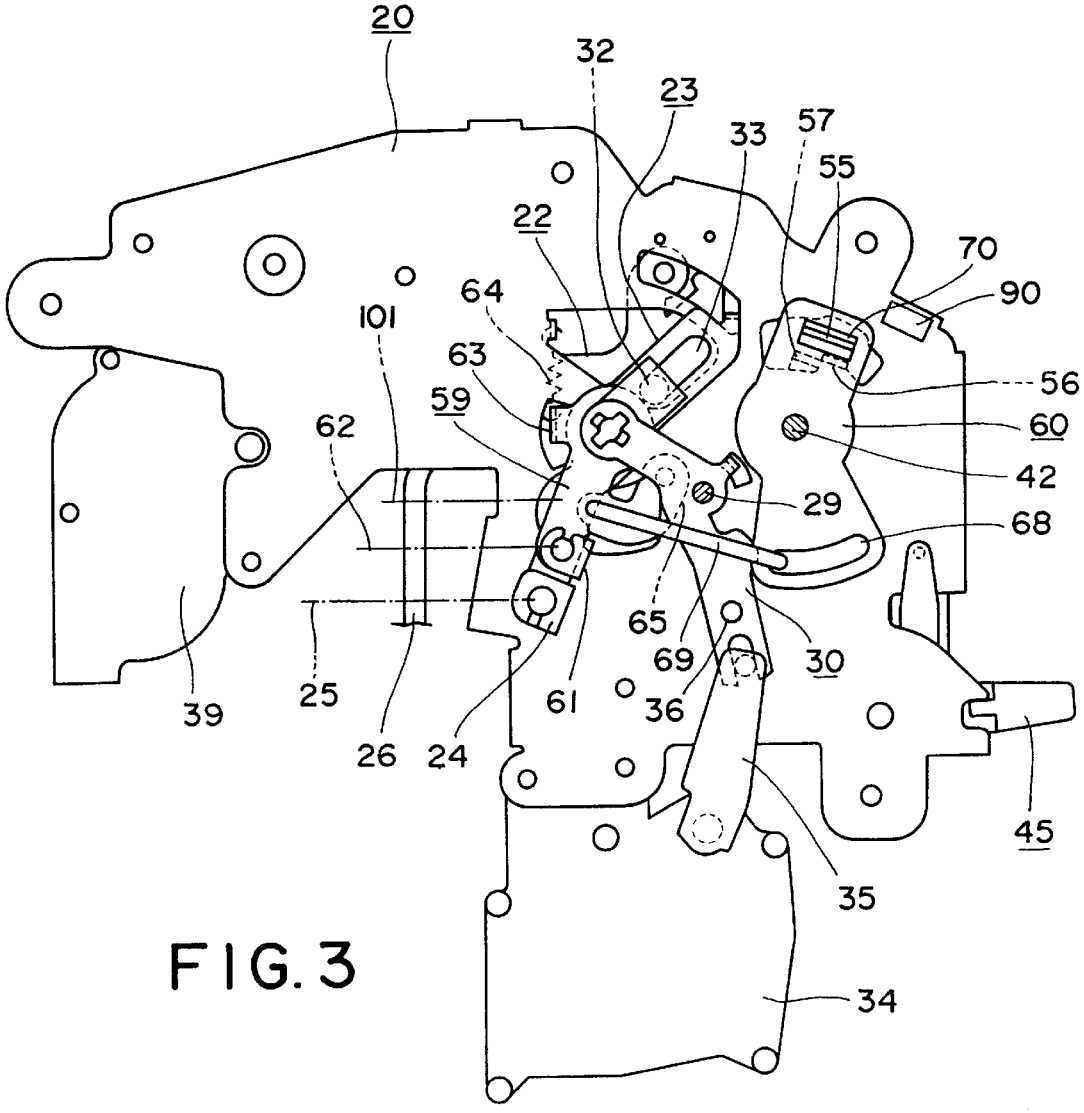
FIG. 3 is a back view of the relay assembly.
Figure 7:
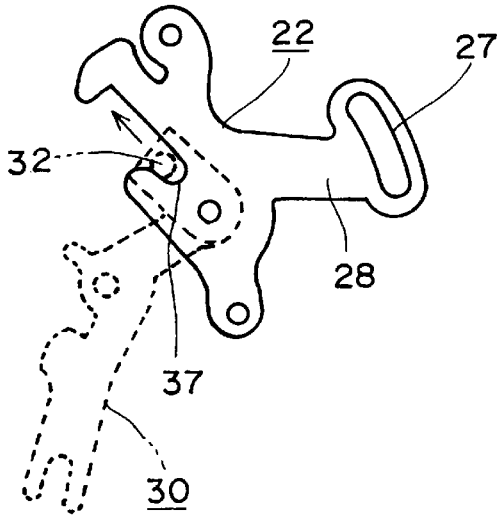
FIG. 7 is a front view of the outer open lever and the lock lever.
Figure 8:
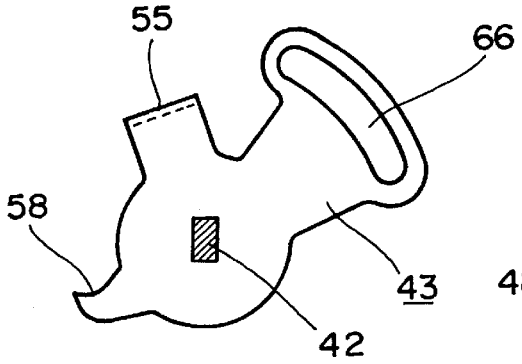
FIG. 8 is a front view of an inner open lever of the relay assembly.
Figure 9:
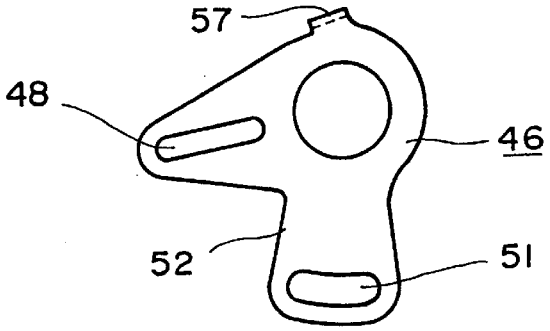
FIG. 9 is a front view of an intermediate lever of the relay assembly.

When the lock lever 30 is in an unlocked position shown in FIG. 3, the tip of the lock pin 32 is engaged with a hook 37 formed in the outer open lever 22, as shown in FIG. 7. Thus, when the outer open lever 22 is turned clockwise in FIG. 2 by the operation of the outside operating handle 14 in the unlocked state, the lock pin 32 which is engaged with the hook 37 causes the latch-unit lever 23 to turn counterclockwise in FIG. 3, and then the slide door 5 is opened. When the lock lever 30 is turned clockwise in FIG. 3, the lock lever 30 is displaced into a locked position, and the lock pin 32 is then moved toward an outer position of the slot 33 to be disengaged from the hook 37 of the outer open lever 22. Therefore, in the locked state, the movement of the outer open lever 22 is not transmitted to the latch-unit lever 23, and accordingly, the slide door 5 cannot be opened.

An upper arm 38 of the outer open lever 22 is connected to an output lever 40 of a motorized actuator 39 through a rod 41, so as to be arranged that the power of the actuator 39 can release the latch units 11, 13.

The door opening mechanism further comprises an inner open lever 43 (FIGS. 2 and 8) which is positioned on the front side of the base plate 20 and is fixed to a front end of a rotary shaft 42. To the rear end of the rotary shaft 42, as shown in FIGS. 2 and 16, the stick-shaped inside operating handle 15 is fixed. The inner open lever 43 is relevantly connected to the outer open lever 22 through the child-proof mechanism of the relay assembly 17.

The child-proof mechanism comprises a child-proof lever 45 rotatably attached to the base plate 20 by a shaft 44, an intermediate lever 46 (FIGS. 2 and 9) rotatably mounted on the shaft 42, and a child-proof pin 49 slidably engaged in both of a slot 47 of the child-proof lever 45 and a slot 48 of the intermediate lever 46. The intermediate lever 46 includes a lower arm 52 having an elongated arc slot 51 in which one end of a rod 50 is connected with a lost-motion, and the other end of the rod 50 is connected to a lower arm 53 of the outer open lever 22.

As mentioned above, the inside operating handle 15 can turn in both directions of the door-opening direction and the door-closing direction, and the rotary shaft 42, therefore, turns in both directions in FIG. 2 by the turn of the inside operating handle 15. When the inside operating handle 15 is turned in the door-closing direction by being pressed in the forward direction of the body 2 in order to close the door 5, the shaft 42 is turned counterclockwise in FIG. 2, and when the inside operating handle 15 is turned in the door-opening direction by being pressed in the backward direction of the body 2 in order to open the door 5, the shaft 42 is turned clockwise in FIG. 2.

The inner open lever 43 and the inside operating handle 15, both of which is fixed to the shaft 42, are held in the neutral position shown in FIG. 2 by the elasticity of the return spring 54. Leg portions of the return spring 54 selectively come into contact with three bent portions, that is, a bent portion 55 of the inner open lever 43, a bent portion 56 of the base plate 20, and a bent portion 57 of the intermediate lever 46. In the state of FIG. 2, the counterclockwise rotation of the intermediate lever 46 is restricted by the contact between the bent portion 57 and the base plate 20.

Figure 10:
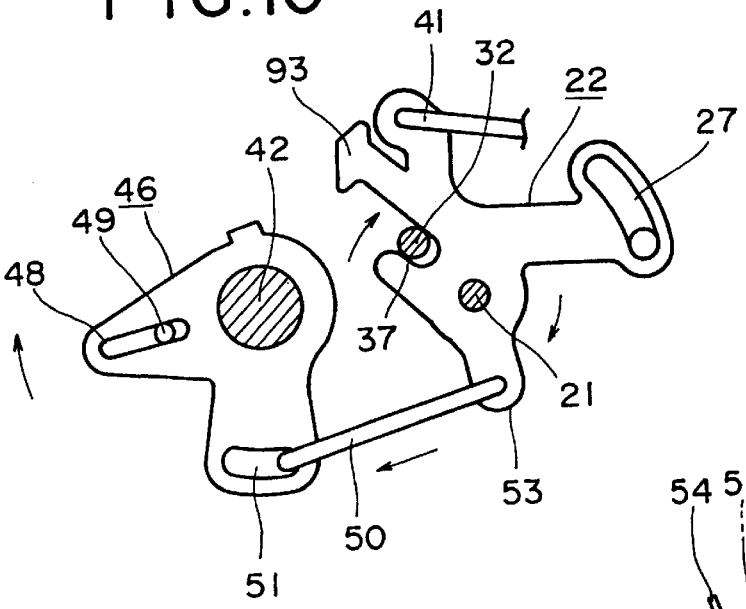
FIG. 10 is a front view showing a state in which the outer open lever and the intermediate lever are connected with each other by of a rod.

The child-proof lever 45 shown in FIG. 2 is in the non-child-proof position, and the child pin 49 is engageably opposed to a claw portion 58 of the inner open lever 43. Accordingly, when the inner open lever 43 is turned clockwise in FIG. 2 by the rotation of the inside operating handle 15 in the door-opening direction, the intermediate lever 46 is also turned clockwise through the child-proof pin 49, and the outer open lever 22 is then turned clockwise through the rod 50 as shown in FIG. 10, thereby the slide door 5 is opened if the locking mechanism is in the unlocked state.

Figure 11:
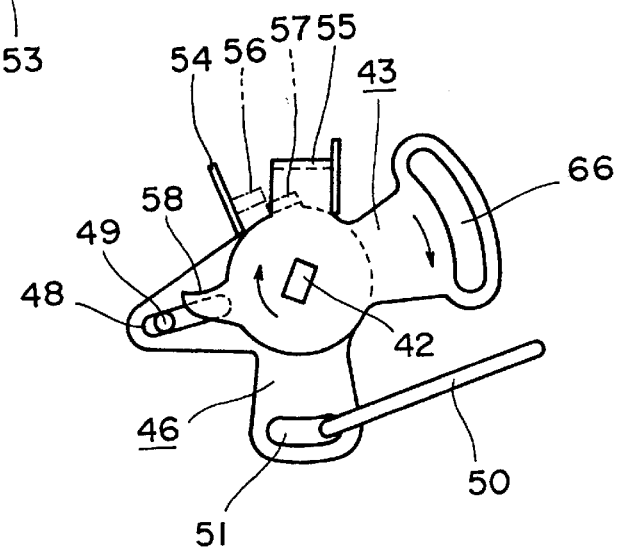
FIG. 11 is a front view of the inner open lever and the intermediate lever.
Figure 13:
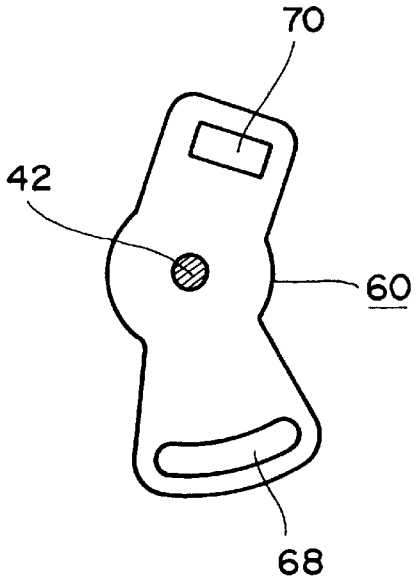
FIG. 13 is a back view of a sub inner lever of the relay assembly.
Figure 12:
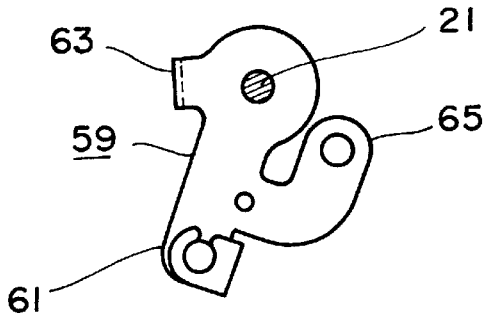
FIG. 12 is a back view of a fail-safe lever of the relay assembly.
Figure 14:
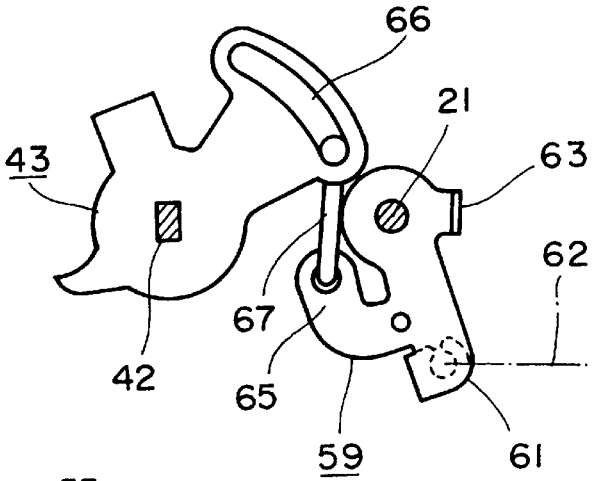
FIG. 14 is a front view showing a state in which the inner open lever and the fail-safe lever are connected with each other by means of a rod.
Figure 15:
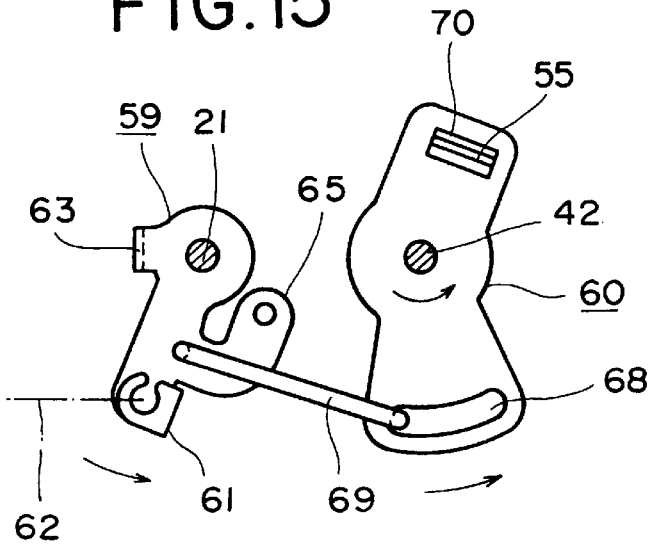
FIG. 15 is a back view showing a state in which the fail-safe lever and the sub inner lever are connected with each other by means of a rod.

The child-proof lever 45 is displaced into the child-proof position due to the counterclockwise rotation thereof in FIG. 2. In the child-proof state, the child-proof pin 49 is in the outer end position of the slot 48 and is disengaged from the claw portion 58 of the inner open lever 43. Therefore, in the child-proof state, as shown in FIG. 11, the movement of the inside operating handle 15 (lever 43) in the door-opening direction is not transmitted to the intermediate lever 46, and accordingly, the slide door 5 is not opened. By the way, when the child-proof mechanism is omitted, the slot 51 in which the rod 50 should be slidably connected, is formed in the inner open lever 43.

The relay assembly 17 has a fail-safe lever 59 (FIGS. 3 and 12) which is rotatably attached on the rear side of the base plate 20 by the shaft 21, and a sub inner lever 60 (FIGS. 3 and 13) which is positioned on the rear side of the base plate 20 and is rotatably mounted on the shaft 42. A lower arm 61 of the fail-safe lever 59 is connected to one end of a rod 62, and the other end of the rod 62 is connected to a fail-safe mechanism of the powered closing unit 19. When the fail-safe lever 59 is turned counterclockwise in FIG. 3, the fail-safe mechanism interrupts the closing operation of the powered closing unit 19 as described later. In a case where the full-open holder 100 is the latch type one, the full-open holder 100 is connected to the fail-safe lever 59 through a rod or wire 101, so that the full-open holder 100 may be released by a turn of the fail-safe lever 59.

The fail-safe lever 59 includes a bent portion 63 which projects to the front side of the base plate 20. The bent portion 63 comes into contact with the lower surface of the right arm 28 of the outer open lever 22 by the elasticity of a spring 64. When the outer open lever 22 is turned clockwise in FIG. 2 by the outside operating handle 14 or the actuator 39, the right arm 28 pushes the bent portion 63 downward to rotate the fail-safe lever 59 counterclockwise in FIG. 3, thereby the operation of the powered closing unit 19 is interrupted. Here, it should be noted that the movement of the outer open lever 22 is transmitted to the fail-safe lever 59 without through the locking mechanism, and therefore, even if the locking mechanism is in the locked state, the operation of the powered closing unit 19 can be interrupted by the outside operating handle 14.

An elbow 65 of the fail-safe lever 59 is projected to the front side of the base plate 20 and is connected to one end of a rod 67, the other end which is connected to an elongated arc slot 66 of the inner open lever 43 with a lost-motion. The fail-safe lever 59 is also connected to one end of a rod 69, the other end of which is connected to an arc slot 68 of the sub inner lever 60 with a lost-motion. The bent portion 55 of the inner open lever 43 is engaged with a connecting hole 70 of the sub inner lever 60, and therefore, the sub inner lever 60 turns as one piece together with the inner open lever 43.

When the shaft 42 is turned clockwise in FIG. 2 by the door-opening rotation of the inside operating handle 15, the inner open lever 43 is also turned clockwise. Then, the sub inner lever 60 which is connected to the inner open lever 43 is turned counterclockwise in FIG. 3 to rotate the fail-safe lever 59 through the rod 69. Accordingly, by the door opening operation of the inside operating handle 15, the closing operation of the powered closing unit 19 can be interrupted.

Further, when the shaft 42 is turned counterclockwise in FIG. 2 by a turn in the door-closing direction of the inside operating handle 15, the inner open lever 43 is also turned counterclockwise. Then, the inner open lever 43 turns the fail-safe lever 59 through the rod 67. Accordingly, the closing operation of the powered closing unit 19 can be interrupted even by the door closing operation of the inside operating handle 15. Thus, in the present invention, by any one of the door opening operation (rotation) and the door closing operation (rotation) of the inside operating handle 15, the closing operation of the powered closing unit 19 can be interrupted. Furthermore, here, it should-be noted that each of the door opening and closing operations of the inside operating handle 15 turns the fail-safe lever 59 without through the child-proof mechanism and locking mechanism, and therefore, even if the child-proof mechanism is in the child-proof state and/or the locking mechanism is in the locked state, the closing operation of the powered closing unit 19 can be stopped by the inside operating handle 15. By the way, in a case where the child-proof mechanism is omitted, the sub inner lever 60 may become unnecessary. Because the clockwise rotation of the inner open lever 43 can be transmitted to the outer open lever through the rod 50.

When closing the slide door 5, the inside operating handle 15 is pressed in the forward direction of the body 2 and is turned in the door-closing direction, and the shaft 42 is then turned counterclockwise in FIG. 2 to turn the inner open lever 43 counterclockwise, thereby the fail-safe lever 59 is turned through the rod 67. Then, the full-open holder 100 which is connected to the fail-safe lever 59 through the rod or wire 101, is released, and after that, if the inside operating handle 15 is successively pressed forward, the slide door 5 can smoothly be moved toward the closed position.

Figure 18:
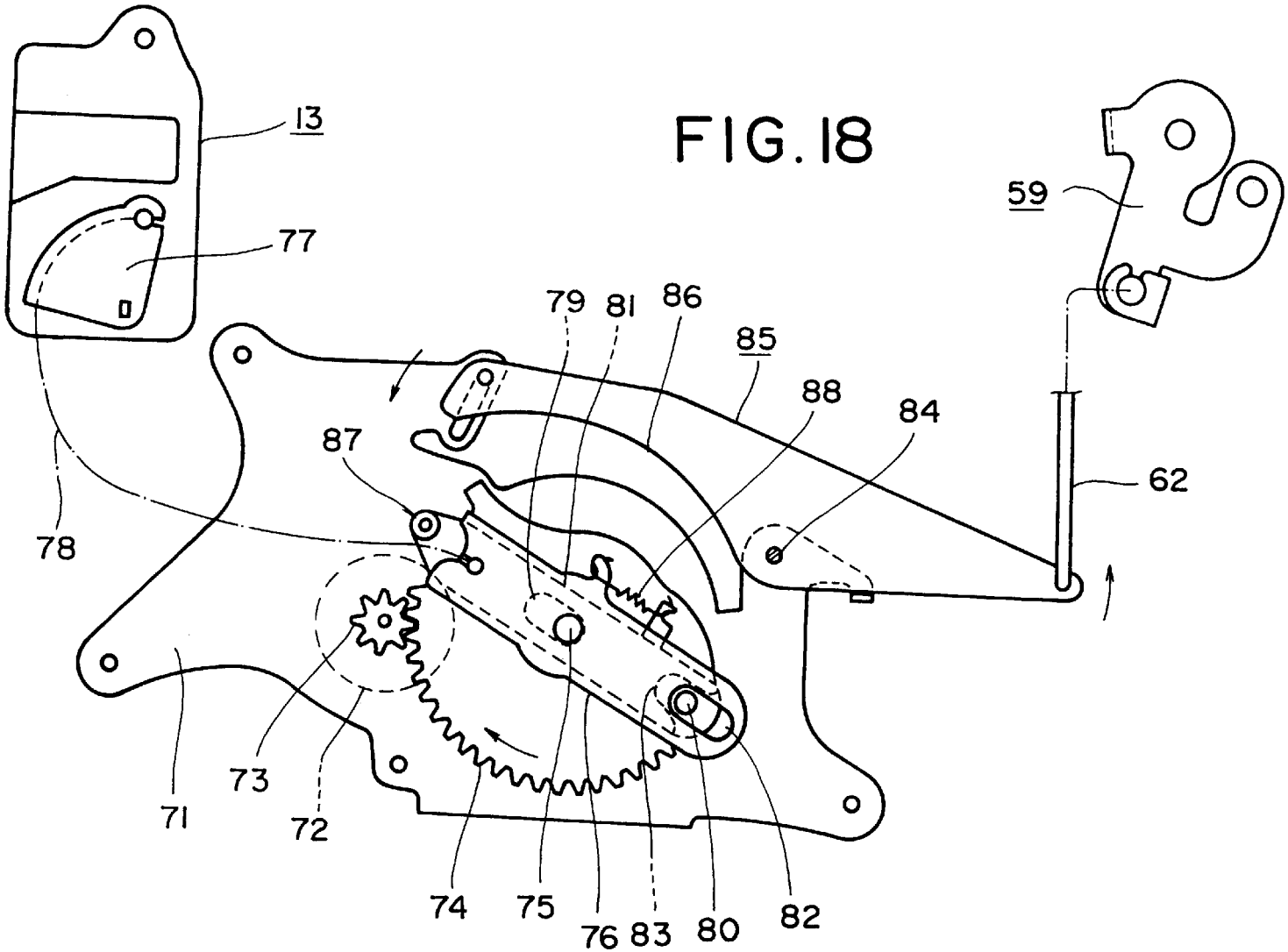
FIG. 18 is a front view of a powered closing unit of the operational apparatus.
Figure 19:
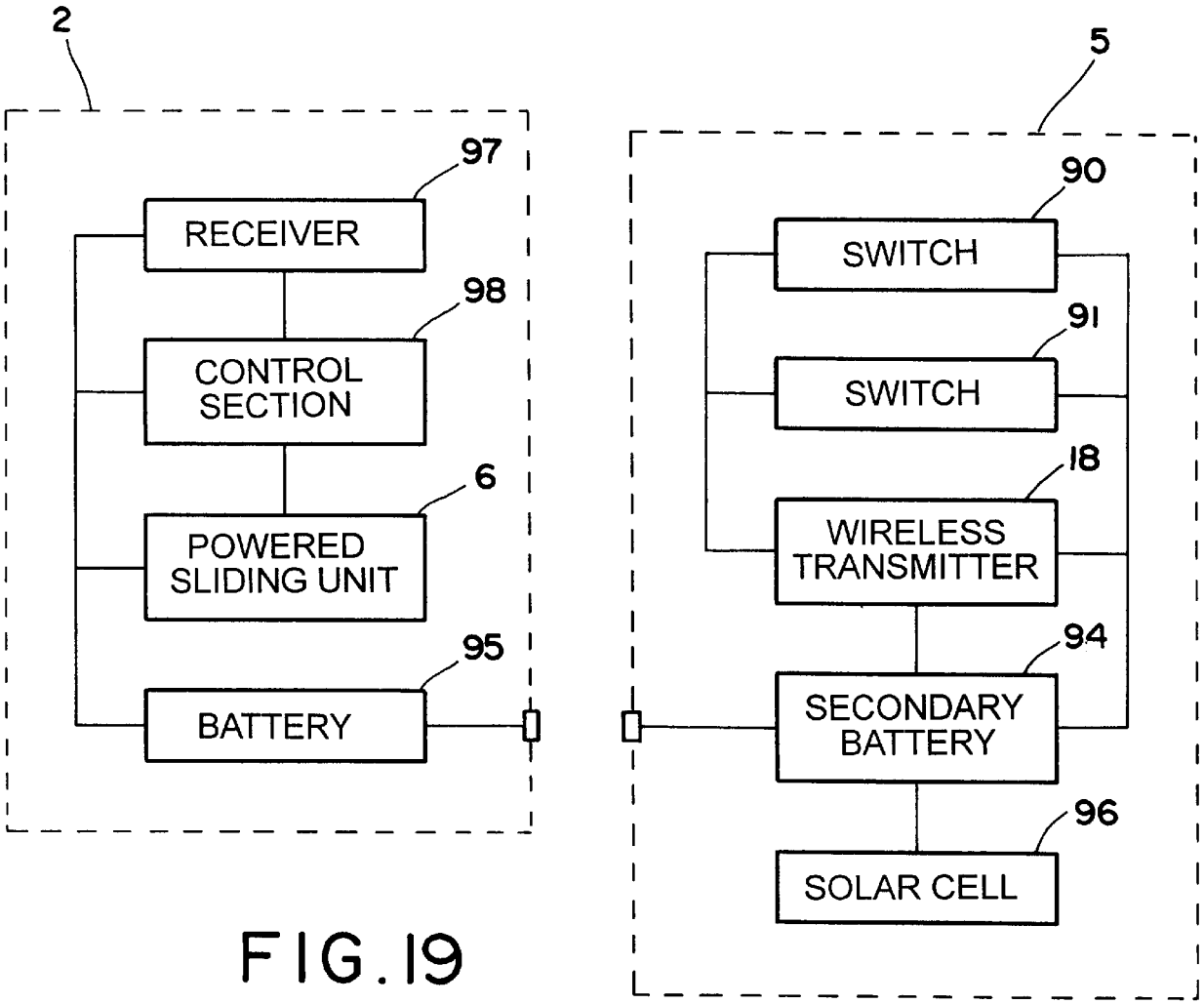
FIG. 19 is a block circuit diagram of the operational apparatus.

FIG. 18 shows the powered closing unit 19. The closing unit 19 comprises a motor 72 fixed to a base plate 71 of the unit 19, and a sector gear 74 engaged with an output gear 73 of the motor 72. The sector gear 74 is rotatably supported to the base plate 71 by a shaft 75 on which an output lever 76 is rotatably mounted. The output lever 76 is connected to a wire lever 77 of the rear latch unit 13 through a wire 78. A slide lever 81 is provided between the sector gear 74 and the output lever 76, and has a pin 80 and a slot 79 into which the shaft 75 is inserted. One end of the pin 80 of the slide lever 81 is slidably engaged with a slot 82 of the output lever 76 and the other end of the pin 80 is detachably engaged with a U-shaped groove 83 of the sector gear 74. When the sector gear 74 is turned clockwise by the motor 72, the U-shaped groove 83 pushes the pin 80 to rotate the output lever 76 clockwise, the wire lever 77 is then rotated through the wire 78. The rotational movement of the wire lever 78 causes the latch unit 13 to move the slide door 5 from the half-latched position to the full-latched position.

The fail-safe mechanism of the powered closing unit 19 is substantially comprised of a cancelling lever 85 attached to the base plate 71 by a shaft 84 and the slide lever 81. The cancelling lever 85 is connected to the fail-safe lever 59 of the relay assembly 17 through the rod 62. While the output lever 76 is turned clockwise by the motor 72, if the cancelling lever 85 is turned counterclockwise by the fail-safe lever 59, an arc surface 86 of the cancelling lever 85 is brought into contact with a roller 87 of the slide lever 81 to slide the slide lever 81 against the elasticity of a spring 88, so that the pin 80 is disengaged from the U-shaped groove 83 of the sector gear 74. Consequently, the output lever 76 loses the power, and the closing of the slide door 5 is stopped.

Figure 17:
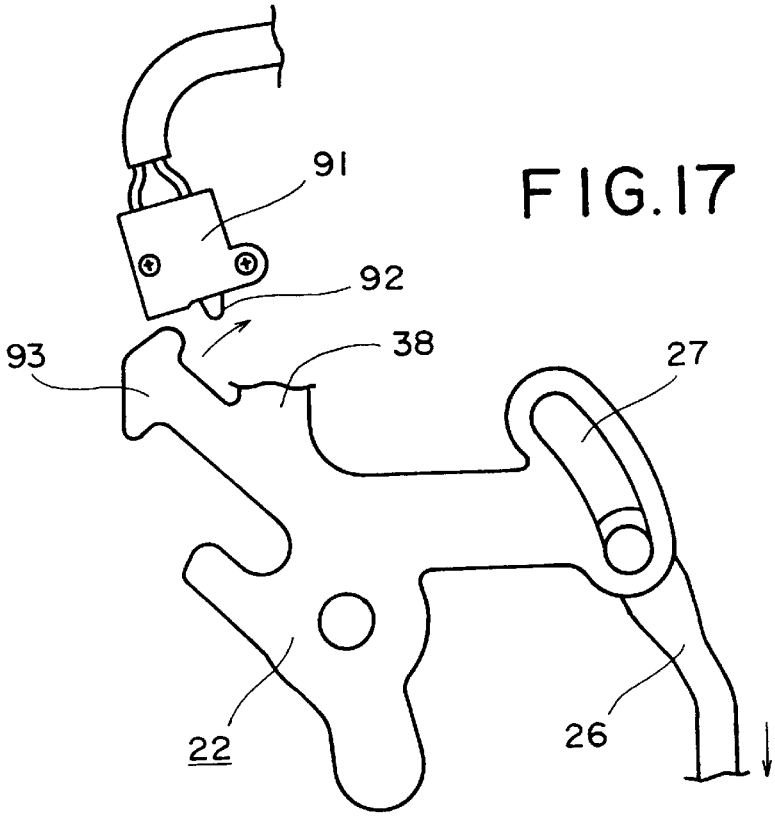
FIG. 17 is a front view of the outer open lever and a switch.

To the base plate 20, a first switch or sensor 90 for detecting the rotation of the inside operating handle 15 in the door-closing direction, and a second switch or sensor 91 for detecting the rotation of the outer open lever 22 are attached. A terminal 92 (FIG. 17) of the switch 91 is pressed with an inclined arm 93 of the outer open lever 22, by an initial rotation of the outer open lever 22. Each operation signal from the switches 90, 91 is sent to the wireless transmitter 18, and then the wireless transmitter 18 sends out infrared rays or radio waves by the electric power of a secondary battery 94. The secondary battery 94 is charged with the electric power from a battery 95 provided on the vehicle body 2 while the door 5 is closed, or it is charged with the electric power from a solar cell 96.

To the body 2, a receiver 97 for receiving signals from the wireless transmitter 18, and a control section 98 are provided. While the slide door 5 is in the door opening state, when the receiver 97 receives the signals from the transmitter 18, the control section 98 turns the motor 7 of the powered sliding unit 6 in the door-closing direction, and while the slide door 5 is in the door closing state, when the receiver 97 receives the signals, the control section 98 turns the motor 7 of the powered sliding unit 6 in the door-opening direction. Since the switch 91 is turned ON by the initial rotation of the outer open lever 22, the manipulated variable of the outside operating handle 14 can be minimized, and even if the operator carries a large piece of baggage, the operation is easy.

What is claimed is:

1. An operational apparatus adapted for use with a vehicle door, comprising a latch unit adapted to be fixed to the vehicle door for holding the vehicle door in a full-latched position by engaging with a striker fixed to a vehicle body;

an outside handle adapted to be provided on an outer surface of the vehicle door;

an outer open lever connected to the outside handle and the latch unit adapted for releasing the striker from the latch unit so as to open the vehicle door when the outside handle is operated;

a locking mechanism having an unlocked position where the outer open lever is connected to the latch unit and a locked position where the outer open lever is disconnected from the latch unit;

an inside handle adapted to be provided on an inner surface of the vehicle door and being rotatable in a door-opening direction;

an inner open lever connected to the inside handle;

a child-proof mechanism having a non-child-proof position where a movement of the inner open lever by a door-opening rotation of the inside handle in the door-opening direction is transmitted to the outer open lever and a child-proof position where the movement of the inner open lever by the door-opening rotation of the inside handle is not transmitted to the outer open lever;

a powered closing unit adapted for transmitting a power to move the vehicle door from a half-latched position to the full-latched position to the latch unit;

a fail-safe lever connected to the powered closing unit and the outer open lever without engagement through the locking mechanism for interrupting an operation of the powered closing unit when moved; and a sub inner lever connected to the inside handle, said sub inner lever transmitting the door-opening rotation of the inside handle to the fail-safe lever without engaging through the child-proof mechanism;

wherein said fail-safe lever is moved in the same direction both by the door-opening rotation of the inside handle and by a rotation of the outer open lever.

2. The operational apparatus according to claim 1, wherein said vehicle door is slidably attached to the vehicle body and is able to be moved both in the door-opening direction and in a door-closing direction; said inside handle being also rotatable in the door-closing direction opposite to the door-opening direction, and a powered sliding unit adapted to move the slide door in the door-closing direction when said inside handle is rotated in the door-closing direction.

3. The operational apparatus according to claim 2, wherein said inner open lever is connected to the fail-safe lever so that a rotation of the inside handle in the door-closing direction is transmitted to the fail-safe lever to move the fail-safe lever in the same direction.

4. An operational apparatus adapted for use with a vehicle slide door, comprising a latch unit adapted to be fixed to the slide door for holding the slide door in a full-latched position by engaging with a striker fixed to a vehicle body;

an outside handle adapted to be provided on an outer surface of the slide door;

an inside handle adapted to be provided on an inner surface of the slide door and being rotatable from neutral position both in a door-opening direction equivalent to a backward direction of the vehicle body by a door-opening operational force and in a door-closing direction equivalent to a forward direction of the vehicle body by a door-closing operational force;

an outer open lever for releasing the striker from the latch unit, said outer open lever being connected to the outside handle and the inside handle and moved by a rotation of the inside handle in the door-opening direction and by a rotation of the outside handle;

a powered sliding unit adapted for moving the slide door along a guide rail fixed to the vehicle body in the door-opening direction and the door-closing direction;

a switch for detecting a rotation of the inside handle in the door-closing direction; and control means for moving the slide door along a guide rail fixed to the vehicle body in the door-closing direction by using the powered sliding unit when said switch detects the rotation of the inside handle in the door-closing direction.

5. The operational apparatus according to claim 4, further comprising a powered closing unit adapted for transmitting a power of moving the slide door from a half-latched position to the full-latched position to the latch unit, and a fail-safe lever for interrupting an operation of the powered closing unit, wherein said fail-safe lever adapted to be connected to the inside handle such that either of door-opening and door-closing rotations of the inside handle is transmitted to the fail-safe lever to interrupt the operation of the powered closing unit.

6. An operational apparatus adapted for use with a vehicle slide door, comprising a latch unit adapted to be fixed to the slide door for holding the slide door in a full-latched position by engaging with a striker fixed to a vehicle body;

a full-open holder for holding the slide door in a full-open position;

an outside handle adapted to be provided on an outer surface of the slide door;

an outer open lever connected to the outside handle, said outer open lever being connected to the latch unit and the full-open holder so that the latch unit and the full-open holder are released by a rotation of the outside handle;

an inside handle adapted to be provided on an inner surface of the slide door and being rotatable from a neutral position both in a door-opening direction equivalent to a backward direction of the vehicle body by a door-opening operational force and in a door-closing direction equivalent to a forward direction of the vehicle body by a door-closing operational force; and an inner open lever connected to the inside handle, the outer open lever and the full-open holder;

wherein said inner open lever moves the outer open lever when said inside handle is rotated in the door-opening direction and said inner open lever releases the full-open holder when said inside handle is rotated in the door-closing direction.

7. The operational apparatus according to claim 6, further comprising a powered closing unit adapted for transmitting a power of moving the slide door from a half-latched position to the full-latched position to the latch unit, and a fail-safe lever for interrupting an operation of the powered closing unit, wherein said fail-safe lever is connected to the inside handle such that either of door-opening and door-closing rotations of the inside handle is transmitted to the fail-safe lever to interrupt the operation of the powered closing unit.

8. The operational apparatus according to claim 7, further comprising a child-proof mechanism having a non-child-proof position where a movement of the inner open lever by the door-opening rotation of the inside handle is transmitted to the outer open lever and a child-proof position where the movement of the inner open lever by the door-opening rotation of the inside handle is not transmitted to the outer open lever, and a sub inner lever connected to the inside handle, wherein said fail-safe lever is moved through the sub inner lever when said inside handle is rotated in the door-opening direction, and said fail-safe lever is moved through the inner open lever when said inside handle is rotated in the door-closing direction.

9. An operational apparatus adapted for use with a vehicle slide door, comprising a latch unit adapted to be fixed to the slide door for holding the slide door in a full-latched position by engaging with a striker fixed to a vehicle body;

an outside handle adapted to be provided on an outer surface of the slide door;

an outer open lever connected to the outside handle and the latch unit for releasing the striker from the latch as to open the slide door when the outside handle is operated;

a powered sliding unit adapted for moving the slide door in a door-opening direction and in a door-closing direction;

a switch for detecting a rotation of the outer open lever;

a wireless transmitter adapted to be provided in the slide door sending out an infrared signal or a radio signal on the basis of a signal from the switch;

a receiver adapted to be provided in the vehicle body and receiving the signal from the wireless transmitter; and control means for moving the slide door in the door-opening direction and in the door-closing direction by using the powered sliding unit when said receiver receives the signal.

* * * * *